United States Patent [19]

Instance

[11] Patent Number: 5,031,938

[45] Date of Patent: Jul. 16, 1991

[54] LABELS AND MANUFACTURE THEREOF

[76] Inventor: David J. Instance, Guinea Hall, Sellindge, United Kingdom

[21] Appl. No.: 391,527

[22] PCT Filed: Nov. 24, 1988

[86] PCT No.: PCT/GB88/01034

§ 371 Date: Jul. 24, 1989

§ 102(e) Date: Jul. 24, 1989

[87] PCT Pub. No.: WO89/05021

PCT Pub. Date: Jun. 1, 1989

[51] Int. Cl.[5] ..... B42D 15/00

[52] U.S. Cl. ..... 283/81; 283/100; 283/101

[58] Field of Search ..... 281/2, 1; 282/1, 2, 282/3; 283/61, 81, 101, 100

[56] References Cited

U.S. PATENT DOCUMENTS

| | | | |
|---|---|---|---|
| 4,210,688 | 7/1980 | Sato | 283/101 |
| 4,379,573 | 4/1983 | Lomeli et al. | 283/81 |
| 4,529,229 | 7/1985 | Glibbery | 283/81 |
| 4,534,582 | 8/1985 | Howard | 283/81 |

FOREIGN PATENT DOCUMENTS

| | | |
|---|---|---|
| 0130053 | 6/1984 | European Pat. Off. . |
| 0153186 | 2/1985 | European Pat. Off. . |

*Primary Examiner*—Frank T. Yost
*Assistant Examiner*—Hwei-Siu Payer
*Attorney, Agent, or Firm*—Hill, Van Santen, Steadman & Simpson

[57] ABSTRACT

A self-adhesive label has a label base secured by pressure sensitive adhesive to release backing material. A portion of the upper surface of the label base is provided with a layer of varnish, and a label is adhesively secured in releasable fashion to the upper surface of the varnish layer.

12 Claims, 2 Drawing Sheets

LABELS AND MANUFACTURE THEREOF

The present invention relates to a label and to a method of producing labels.

The present invention provides a self-adhesive label comprising a label base portion, which is coated on its rear surface with pressure sensitive adhesive and is carried on a release backing material, a varnish layer which extends over at least a part of the front surface of the label base portion and a label portion which is adhered by a region of adhesive to the front surface of the label base portion, at least a part of the label portion being releasably adhered to the varnish layer.

In one preferred embodiment of the present invention, the label portion is folded and includes a rear part which is fixedly adhered directly to the label base portion and a front part which covers the rear part and is releasably adhered to the varnish layer, the front part being selectively releasable from the varnish layer thereby to reveal the rear part.

The label portion preferably comprises a folded longitudinal strip which is divided into a row of panels by a series of transverse fold lines, an end panel of the strip comprising the said front part and an adjacent panel comprising the said rear part, and a free transverse edge of the front part being releasably adhered to the varnish layer.

Advantageously, the free transverse edge, when released from the varnish layer, retains the adhesive on the rear surface of the free transverse edge whereby the free transverse edge can be subsequently re-adhered to the varnish layer.

In a second preferred embodiment of the present invention, the whole of the rear surface of the label portion is adhered to the varnish layer wherebY the whole of the label portion is releasably adhered to the label base portion.

Preferably, the label portion, when released from the label base portion, retains the adhesive on the rear surface of the label portion whereby the label portion can be adhered to an article.

The present invention also provides a method of producing self-adhesive labels carried on a release backing material, the method comprising the steps of:

(a) providing a support layer coated on its rear surface with a pressure sensitive adhesive and which is carried on a release backing material;

(b) coating at least a part of the front surface of the support layer with a varnish layer;

(c) applying a region of adhesive to the front surface of the support layer, the region of adhesive covering at least a part of the varnish layer; and (d) applying a face of a label portion to the region of adhesive whereby that part of the label portion which covers the said part of the varnish layer is releasably adhered thereto.

In one preferred embodiment of the present invention, the label portion is folded and includes a rear part which is fixedly adhered directly to an area of the front surface of the support layer which is not coated with the varnish layer and a front part which covers the rear part and is releasably adhered to the varnish layer, the front part being selectively releasable from the varnish layer thereby to reveal the rear part.

The label portion preferably comprises a folded longitudinal strip which is divided into a row of panels by a series of transverse fold lines, an end panel of the strip comprising the said front part and an adjacent panel comprising the said rear part, and a free transverse edge of the front part being releasably adhered to the varnish layer.

In a second preferred embodiment of the present invention, the whole of the rear surface of the label portion is adhered to the varnish layer whereby the whole of the label portion is releasably adhered to the support layer.

The method may further comprise the step, at any stage in the method after step (a), of cutting the support layer into a series of label base portions, and wherein a succession of the label portions is applied to successive regions of adhesive whereby a succesion of self-adhesive labels is produced on the release backing material, each including a respective label portion and a respective label base portion.

Preferably, the cutting step is carried out after applying step (b) and each label portion is cut simultaneously with the cutting of the respective label base portion so as to have at least one cut edge of the label portion in registry with a cut edge of the respective label base portion.

Embodiments of the present invention will now be described by way of example only with reference to the accompanying drawings, in which.

Figure 1:
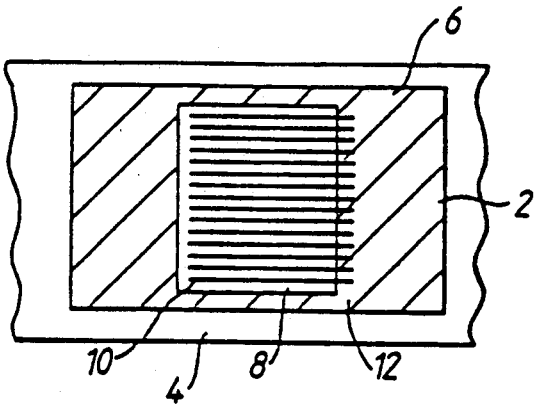
FIG. 1 is a plan view of a label base portion of a self-adhesive label in accordance with the first embodiment of the present invention carried on a backing of release material.

Referring to FIG. 1, a label base portion 2 has a self-adhesive rear surface which is releasably adhered to a backing 4 of release material, such as waxed or polysiloxane-coated paper. The rear surface of the label base portion 2 is coated with a pressure sensitive adhesive. The label base portion 2 has been die-cut from an elongate web of self-adhesive paper carried on the backing 4, and the waste web remnant has been removed. The upper surface of the label base portion 2 has been printed with desired images. A layer of varnish 6 extends over the whole of the upper surface of the label base portion 2 except for a central part 8 thereof. The varnish layer has been printed, e.g. by means of a printing cylinder, over the printed upper surface of the label base portion 2 in the last step of the printing process for the label base portion. In the preferred embodiment, the elongate web of self-adhesive paper is printed, with the desired images, and then with the varnish layer 6, and then the web is die-cut to form the label base portions 2. The varnish of the varnish layer 6 consists of a gloss over-printing varnish which is solvent-based.

An adhesive is then applied to the upper surface of the label base portion 2. The adhesive is extruded from an applicator in the form of a series of parallel beads 10 which extend across the central part 8 of the label base portion 2 and also across a strip 12 of the varnish layer 6 which is disposed at a transverse edge of the central part 8. Alternatively, the adhesive may be printed onto the upper surface of the label base portion 2, e.g. by means of a printing roller. It will be understood by those skilled in the art that the printed adhesive can be in the form of a continuous layer of adhesive rather than in the form of beads of adhesive. The adhesive is typically a water-based adhesive, such as a pva adhesive, and a suitable adhesive is sold in the UK as Monarch Adhesive 4974.

The adhesive and varnish compositions are preferably selected such that the varnish seals the coated surface of the label base portion sufficiently so as to render that surface substantially non-absorbent to the adhesive whereby the adhesive dries back into the rear surface of a folded strip or removable label portion which is applied over the adhesive in the manner described hereinafter.

Figure 2:
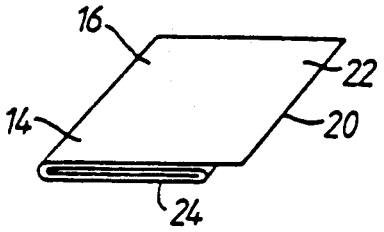
FIG. 2 is a perspective view of a folded strip to be applied to the label base Portion of FIG. 1 thereby to form the label of the first embodiment of the present invention.

FIG. 2 shows a folded strip 14 to be adhered to the label base portion by the adhesive beads 10 thereby to form a label of the present invention. The folded strip 14 consists of a row of panels which have been folded about a series of transverse fold lines to form a flattened tube. An end panel 16 constitutes a top cover panel which covers the remaining panels. A longitudinal edge 20 of the top cover panel 16 extends beyond the remaining panels thereby to form an elongate flap 22. The rear face of the folded strip 14 is comprised of the outer face of that panel 24 which is adjacent the top cover panel 16 and the rearwardly facing surface of the flap 22.

Figure 3:
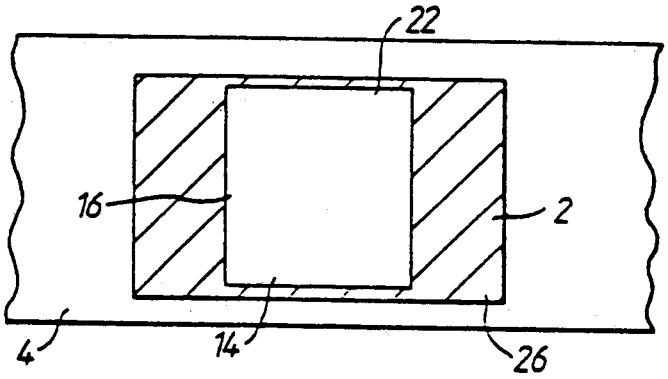
FIG. 3 is a plan view of the label of the first embodiment of the present invention carried on the backing of release material.

FIG. 3 shows a self-adhesive label 26 of the first embodiment of the present invention which has been formed by adhering, by means of the adhesive beads 10, the outer face of the panel 24 to the central part 8 of the label base portion 2 and the rearwardly facing surface of the flap 22 to the strip 12 of the varnish layer 6. The adhesive beads 10 constitute a region or layer of adhesive which adheres the folded strip 14 to the label base portion 2. In the label 26, the panel 16 constitutes a front cover panel, and the panel 24 a back cover panel, between which the remaining panels are folded. The folded strip 14 of the label 26 is maintained in its closed configuration by the adhesion of the flap 22 to the strip 12 of the varnish layer 6. The label 26 is releasably adhered to the release backing material 4.

Figure 4:
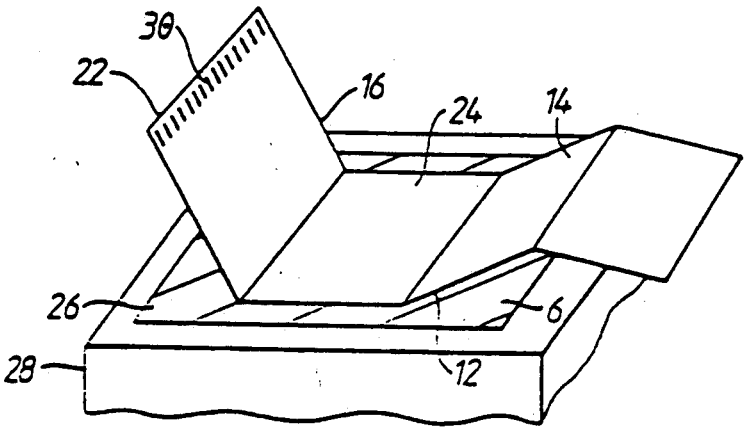
FIG. 4 is a perspective view of the label of FIG. 3 in an unfolded configuration when adhered to a product.

Referring to FIG. 4, the self-adhesive label 26 has been removed from the release backing material 4 and adhered to a product 28, the label 26 may be opened by releasing the flap 22 of the folded strip 14 from being adhered to the varnish layer 6. This is done by pulling the free transverse edge of the flap 22 away from the varnish layer 6. The portions 30 of the adhesive beads 10 which are between the flap 22 and the strip 12 of the varnish layer adhere preferentially to the inside surface of the flap 22. Thus when the flap 22 is pulled away from the varnish layer 6, the portions 30 remain adhered to the flap 22 and are removed from the varnish layer 6. The remaining panels of the folded strip 14 can then be unfolded as shown in FIG. 4. When it is desired to reclose the label 26, the remaining panels can be refolded and the portions 30 of adhesive can be readhered to the varnish layer 6 by refolding the flap 22 over the remaining Panels and pressing the free transverse edge of the flap 22 into engagement with the varnish layer.

The label illustrated in FIG. 4 constitutes a neat and simple arrangement for a resealable folded label. The label may be easily manufactured. In contrast to known arrangements, the folded strip does not require adhesive bands, strips or release layers but it can simply comprise a folded strip of paper. The folded strip is simply applied to a layer of adhesive, formed from the adhesive beads 10, which extends over an unvarnished portion and a varnished portion of a label base portion, with a free outer edge of a front cover panel being in registry above the varnish portion and the back cover panel being fixedly adhered to the unvarnished portion.

Figure 5:
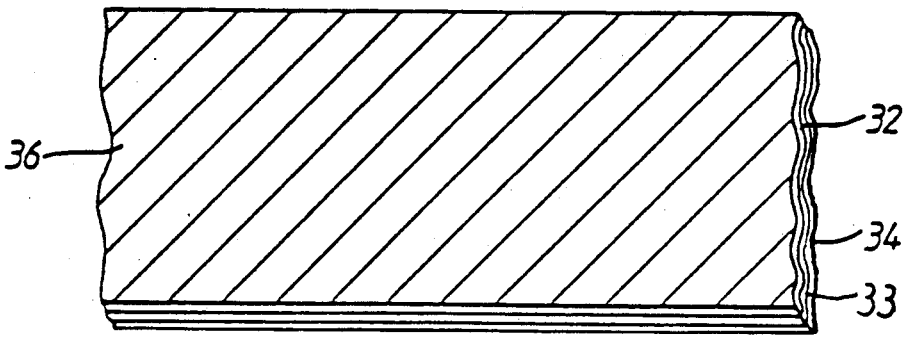
FIG. 5 is a plan view of a varnished self-adhesive base web carried on a backing of release material.
Figure 6:
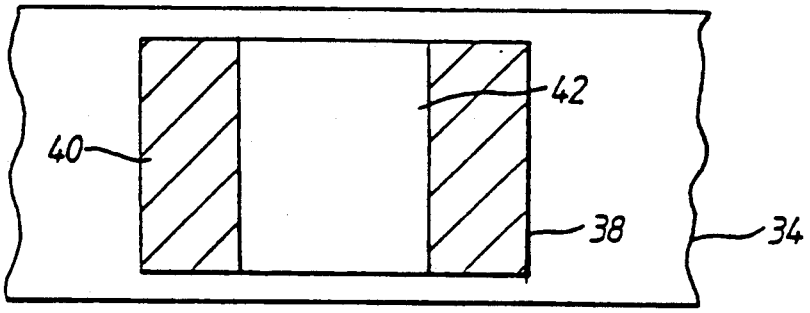
FIG. 6 is a plan view of a self-adhesive label in accordance with the second embodiment of the present invention, the label including a label base portion formed from the web of FIG. 5 and carried on the backing of release material.

FIGS. 5 and 6 show a second embodiment of the present invention. In FIG. 5, there is shown a paper web 32 coated on its rear surface with a pressure-sensitive adhesive 33 and carried on a web of a release backing material 34. The front surface of the web 32 is coated with a varnish layer 36, the varnish being of the tyPe employed in the embodiment of FIGS. 1 to 4. Referring to FIG. 6, there is shown a self-adhesive label 38 in accordance with the second embodiment of the present invention carried on the release backing material 34. The self-adhesive label 38 consists of a label base portion 40 which has been die-cut from the web 32. The rear face of a removable label portion 42, such as the folded strip shown in FIG. 2, is adhered to the varnish layer 36 by a layer of adhesive, the adhesive being such as that employed in the embodiment of FIGS. 1 to 4 for the adhesive beads 10. The removable label portion 42 is thereby releasably adhered to the label base portion 40 due to the preferential adhesion of the adhesive layer to the rear face of the removable layer 42 rather than to the varnish layer. The removable label 42 can be pulled away from the label base portion 40 and subsequently adhered by its rear face, which is coated with the adhesive which has been stripped off the varnish layer 36, to any desired surface. The removable label 42 can also be readhered to the label base portion 40. The removable label 42 may consist of any desired folded label, such as a folded strip or a booklet.

In order to make the label of the second embodiment, a series of adhesive layers is applied along the length of the web 32 and removable labels 42 are applied in succession to respective adhesive layers. The web 32 and the removable labels 42 adhered thereto are then die-cut at a die-cutting station to form a succession of label base portions 40 each with a respective removable label 42 adhered thereto. In the die-cutting step, the two opposed longitudinal edges of the removable label 42 are preferably die-cut also so that in the resultant self-adhesive label 38 the longitudinal edges of the removable panel 42 coincide with the respective longitudinal edges of the label base portion 40. The waste web remnant consisting of the portion of the web outside the label base portions and if appropriate also including the cut-away parts of the removable labels 42 is removed from the release backing material.

The labels of the present invention have a number of advantages over known labels. The layer of varnish is disposed on the label base portion which is of a thicker material than the folded strip and is thus less easily deformed. This results in the resealable labels achieving improved resealability on closing and improved releasability on opening when compared to known labels since the relatively thick and extensive label base portion is rigid and resists being deformed when the folded strip is pulled open or pushed shut. Also, the folded strip which is adhered to the label base portion is easily manufactured and handled since it does not require a release layer of polysiloxane or adhesive layer to be applied thereto prior to being adhered to the label base portion. Furthermore, the labels of the present invention may conveniently and easily be manufactured in a continuous process.

What is claimed is:

1. A self-adhesive label comprising a label base portion, which is coated on its rear surface with pressure sensitive adhesive and is carried on a release backing material, a varnish layer which extends over at least a part of the front surface of the label base portion and a folded label portion which is adhered by a region of adhesive to the front surface of the label base portion, the folded label portion covering the region of adhesive whereby the region of adhesive does not extend beyond the folded label portion and at least a part of the folded label portion being releasably adhered by the region of adhesive to the varnish layer.

2. A self-adhesive label according to claim 1, wherein the label portion includes a rear part which is fixedly adhered directly to the label base portion and a front part which covers the rear part and is releasably adhered to the varnish layer, the front part being selectively releasable from the varnish layer thereby to reveal the rear part.

3. A self-adhesive label according to claim 2, wherein the label portion comprises a folded longitudinal strip which is divided into a row of panels by a series of transverse fold lines, an end panel of the strip comprising the said front part and an adjacent panel comprising the said rear part, and a free transverse edge of the front part being releasably adhered to the varnish layer.

4. A self-adhesive label according to claim 3, wherein the free transverse edge, when released from the varnish layer, retains the adhesive on the rear surface of the free transverse edge whereby the free transverse edge can be subsequently re-adhered to the varnish layer.

5. A self-adhesive label according to claim 1, wherein the whole of the rear surface of the label portion is adhered to the varnish layer whereby the whole of the label portion is releasably adhered to the label base portion.

6. A self-adhesive label according to claim 5, wherein the label portion, when released from the label base portion, retains the adhesive on the rear surface of the label portion whereby the label portion can be adhered to an article.

7. A self-adhesive label comprising a label base portion, which is coated on its rear surface with pressure sensitive adhesive and is carried on a release backing material, a varnish layer on said label base portion which extends over at least a part of the front surface of the label base portion, an adhesive layer on said label base portion which extends over at least a part of said varnish layer, and a folded label portion which is adhered by a region of said adhesive layer to the front surface of the label base portion, the folded label portion covering the adhesive layer whereby the adhesive layer does not extend beyond the folded label portion and at least a part of the folded label portion being releasably adhered by said adhesive layer to the varnish layer.

8. A self-adhesive label according to claim 7, wherein the whole of the rear surface of the label portion is adhered to the varnish layer whereby the whole of the label portion is releasably adhered to the label base portion.

9. A self-adhesive label according to claim 8, wherein the label portion, when released from the label base portion, retains the adhesive on the rear surface of the label portion whereby the label portion can be adhered to an article.

10. A self-adhesive label according to claim 7, wherein the label portion includes a rear part which is fixedly adhered directly to the label base portion and a front part which covers the rear part and is releasably adhered to the varnish layer, the front part being selectively releasable from the varnish layer thereby to reveal the rear part.

11. A self-adhesive label according to claim 10, wherein the label portion comprises a folded longitudinal strip which is divided into a row of panels by a series of transverse fold lines, an end panel of the strip comprising the said front part and an adjacent panel comprising the said rear part, and a free transverse edge of the front part being releasably adhered to the varnish layer.

12. A self-adhesive label according to claim 11, wherein the free transverse edge, when released from the varnish layer, retains the adhesive on the rear surface of the free transverse edge whereby the free transverse edge can be subsequently re-adhered to the varnish layer.

* * * * *